US009129730B1

(12) United States Patent
Maeda

(10) Patent No.: US 9,129,730 B1
(45) **Date of Patent: *Sep. 8, 2015**

(54) RARE-EARTH-IRON-BASED ALLOY MATERIAL

(71) Applicant: Sumitomo Electric Industries, Ltd., Osaka-shi, Osaka (JP)

(72) Inventor: Toru Maeda, Itami (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/712,308

(22) Filed: May 14, 2015

Related U.S. Application Data

(63) Continuation of application No. 13/513,677, filed as application No. PCT/JP2010/071604 on Dec. 2, 2010.

(30) Foreign Application Priority Data

Dec. 4, 2009 (JP) ..... 2009-276275
Nov. 12, 2010 (JP) ..... 2010-253753

(51) Int. Cl.

| | |
|---|---|
| ***B22F 3/26*** | (2006.01) |
| ***H01F 1/055*** | (2006.01) |
| ***H01F 1/08*** | (2006.01) |
| *B22F 3/12* | (2006.01) |

(52) U.S. Cl.
CPC ..... *H01F 1/0552* (2013.01); *H01F 1/08* (2013.01)

(58) Field of Classification Search
CPC ... C22C 38/005; C22C 1/107; H01F 41/0246; H01F 1/0556
See application file for complete search history.

(56) References Cited

U.S. PATENT DOCUMENTS

| | | | |
|---|---|---|---|
| 3,684,499 | A | 8/1972 | Hofer et al. |
| 5,474,623 | A | 12/1995 | Ma et al. |
| 2002/0059965 | A1 | 5/2002 | Honkura et al. |
| 2008/0251159 | A1 | 10/2008 | Odaka et al. |
| 2009/0047594 | A1 | 2/2009 | Hirakawa |
| 2010/0279105 | A1 | 11/2010 | Pyun et al. |

FOREIGN PATENT DOCUMENTS

| | | | |
|---|---|---|---|
| CN | 1100228 | A | 3/1995 |
| CN | 1230755 | A | 10/1999 |
| CN | 1293435 | A | 5/2001 |
| CN | 1842385 | A | 10/2006 |
| CN | 101615459 | A | 12/2009 |
| JP | 53-078096 | A | 7/1978 |

(Continued)

OTHER PUBLICATIONS

Notification of Second Office Action for related Chinese Application No. 201180004578.9, dated Apr. 8, 2014, 17 pages.

(Continued)

*Primary Examiner* — Rebecca Lee
(74) *Attorney, Agent, or Firm* — Ditthavong & Steiner, P.C.

(57) ABSTRACT

Provided are a powder for a magnet, which provides a rare-earth magnet having excellent magnet properties and which has excellent formability, a method for producing the powder for a magnet, a powder compact, a rare-earth-iron-based alloy material, and a rare-earth-iron-nitrogen-based alloy material which are used as materials for the magnet, and methods for producing the powder compact and these alloy materials.

5 Claims, 2 Drawing Sheets

(56) References Cited

FOREIGN PATENT DOCUMENTS

| | | | |
|---|---|---|---|
| JP | 03-129702 | A | 6/1991 |
| JP | 10106875 | A | 4/1998 |
| JP | 11-158588 | A | 6/1999 |
| JP | 2003-031432 | A | 1/2003 |
| JP | 2004-134552 | A | 4/2004 |
| JP | 4029714 | B2 | 1/2008 |
| JP | 2008-172037 | A | 7/2008 |
| JP | 2009-123968 | A | 6/2009 |
| JP | 2011-137218 | A | 7/2011 |
| KR | 10-2002-0033504 | A | 5/2002 |
| WO | 2005/105343 | A1 | 11/2005 |

OTHER PUBLICATIONS

Notice of Decision to Grant for related Korean Application No. 10-2012-7010195, dated Jan. 2, 2014, 2 pages.
Chinese Office Action for related Chinese Application No. 201180004578.9, dated Oct. 17, 2013, 11 pages.
International Search Report for related PCT Application No. PCT/JP2011/060744, dated Aug. 9, 2011, 2 pages.
Notice of Decision to Grant for related Korean Application No. 10-2012-7005937, dated Nov. 20, 2013, 2 pages.
Chinese Office Action for related Chinese Application No. 201180003841.2, dated Aug. 15, 2013, 21 pages.
Japanese Office Action for related Japanese Application No. 2011-036281, dated Apr. 9, 2012, 4 pages.
International Search Report for related PCT Application No. PCT/JP2011/059183, dated Jul. 19, 2011, 1 page.
Office Action for Corresponding Chinese Application No. 201080055027.0 dated Sep. 3, 2013.
Yu et al. "Effect of HD and HDDR Process on Magnetic Properties of Fe-Based Rare Earth Compound" Metallic Functional Materials No. 1, pp. 18-21, Feb. 28, 1997 (English Abstract Included Therein).
Zhang et al. "Development and Characteristics of Nd—Fe—B Powder Preparation" Powder Metallurgy Technology No. 6, pp. 465-469, Dec. 30, 2005 (English Abstract Included Therein).
Notification of Reasons for Rejection for Japanese Patent Application No. 2010-253753 dated Apr. 9, 2012, pp. 1-2 (with partial English Translation).
International Search Report for PCT Application PCT/JP2010/071604 dated Mar. 8, 2011, pp. 1.
Machine translation of JP 11158588, 1999.

RARE-EARTH-IRON-BASED ALLOY MATERIAL

RELATED APPLICATIONS

The present application is a continuation application of U.S. application Ser. No. 13/513,677, filed on Jun. 4, 2012, which is a national stage application under 35 U.S.C. §371 of International Application PCT/JP2010/071604, filed on Dec. 2, 2010, claiming priority to JP 2009-276275, filed on Dec. 4, 2009 and JP 2010-253753, filed on Nov. 12, 2010.

TECHNICAL FIELD

The present invention relates to a powder for a magnet used as a material for a rare-earth magnet, a method for producing the powder for a magnet, a powder compact, a rare-earth-iron-based alloy material, and a rare-earth-iron-nitrogen-based alloy material which are made from the powder, a method for producing a rare-earth-iron-based alloy material, and a method for producing a rare-earth-iron-nitrogen-based alloy material. In particular, the present invention relates to a powder for a magnet, the powder having excellent formability and enabling us to form a powder compact having a high relative density.

BACKGROUND ART

Rare-earth magnets have been widely used as permanent magnets used for motors and power generators. Typical examples of rare-earth magnets include sintered magnets composed of R—Fe—B-based alloys (R: rare-earth element, Fe: iron, B: boron), such as Nd (neodymium)-Fe—B; and bond magnets. In bond magnets, magnets composed of Sm (samarium)-Fe—N(nitrogen)-based alloys have been investigated as magnets having magnet properties superior to those of magnets composed of Nd—Fe—B-based alloys.

A sintered magnet is produced by compacting an R—Fe—B-based alloy and then sintering the resulting compact. A bond magnet is produced by subjecting a mixture of a binder resin and an alloy powder composed of an R—Fe—B-based alloy or a Sm—Fe—N-based alloy to compacting or injection molding. In particular, for alloy powders used for bond magnets, hydrogenation-disproportionation-desorption-recombination (HDDR) treatment (HD: hydrogenation and disproportionation, DR: dehydrogenation and recombination) is performed in order to increase the coercive force While sintered magnets have excellent magnet properties because of its high magnetic phase content, sintered magnets have low degrees of flexibility in shape. It is difficult to form a complex shape, for example, a cylindrical shape, a columnar shape, or a pot-like shape (close-end cylindrical shape). In the case of a complex shape, it is necessary to cut a sintered material. Meanwhile, bond magnets have high degree of flexibility in shape. However, bond magnets have inferior magnet properties to those of sintered magnets. PTL 1 discloses a magnet having an increased degree of flexibility in shape and excellent magnet properties, the magnet being produced by pulverizing an alloy powder composed of a Nd—Fe—B-based alloy, compacting the alloy powder to form a green compact (powder compact), and subjecting the green compact to HDDR treatment.

CITATION LIST

Patent Literature

PTL 1: Japanese Unexamined Patent Application Publication No. 2009-123968

SUMMARY OF INVENTION

Technical Problem

As described above, sintered magnets have excellent magnet properties but low degrees of flexibility in shape. Bond magnets have high degrees of flexibility in shape. However, the magnetic phase content is at most about 80% by volume because of the presence of binder resins. It is difficult to increase the magnetic phase content. It is thus desired to develop a material for a rare-earth magnet, the material having a high magnetic phase content and enabling us to easily produce a complex shape.

For an alloy powder composed of a Nd—Fe—B-based alloy as disclosed in PTL 1 and a powder obtained by subjecting the alloy powder to HDDR treatment, particles constituting each of the powders have high rigidity and are less likely to be deformed. Thus, when a powder compact having a high relative density is formed by compacting without sintering in order to form a rare-earth magnet having a high magnetic phase content, a relatively high pressure is required. In particular, the use of a coarse alloy powder requires a higher pressure. Accordingly, it is desirable to develop a material that enables us to easily form a powder compact having a high relative density.

Furthermore, as described in PTL 1, when the green compact is subjected to the HDDR treatment, the expansion and shrinkage of the green compact during the treatment can collapse the resulting porous body for a magnet. It is thus desirable to develop a material which is less likely to collapse during the production, which has sufficient strength, and which enables us to produce a rare-earth magnet having excellent magnet properties, and to develop a production method thereof.

Accordingly, it is an object of the present invention to provide a powder for a magnet, the powder having excellent formability and enabling us to form a powder compact having a high relative density. It is another object of the present invention to provide a method for producing the powder for a magnet.

It is still another object of the present invention to provide a powder compact, a rare-earth-iron-based alloy material and a production method thereof, and a rare-earth-iron-nitrogen-based alloy material and a production method thereof, which enable us to produce rare-earth magnets having excellent magnet properties.

Solution to Problem

To form a magnet having excellent magnet properties by increasing the magnetic phase content of a rare-earth magnet without sintering, the inventors have conducted studies on the use of a powder compact, unlike a bond magnet that uses a binder resin for molding. As described above, known material powders, i.e., powders composed of Nd—Fe—B-based alloys and Sm—Fe—N-based alloys and treated powders obtained by subjecting these alloy powders to HDDR treatment, are hard and thus have low deformability and poor formability at the time of compacting, thereby causing difficulty in improving the density of the resulting powder compact. The inventors have conducted intensive studies to increase the formability and have found that unlike a powder in which a rare-earth element is bonded to iron, for example, a rare-earth-iron-boron-based alloy or a rare-earth-iron-nitrogen-based alloy, a powder having a texture in which a rare-earth element is not bonded to iron, i.e., in which an iron component and a rare-earth element component are independently present, has high deformability and excellent formability and enables us to produce a powder compact having a high relative density. Furthermore, it has been found that the powder can be produced by subjecting an alloy powder composed of a rare-earth-iron-based alloy to specific heat treatment. It has also been found that a powder compact obtained by compacting the resulting powder is subjected to specific heat treatment to provide a rare-earth-iron-based alloy material similar to that obtained by subjecting a green compact to HDDR treatment or the case where a powder compact is made from a treated powder that has been subjected to HDDR treatment and that, in particular, the use of a rare-earth-iron-based alloy material obtained from a powder compact having a high relative density produces a rare-earth magnet having a high magnetic phase content and excellent magnet properties. These findings have led to the completion of the present invention.

A powder for a magnet according to the present invention is a powder used for a rare-earth magnet, in which magnetic particles constituting the powder for a magnet each contain a hydride of a rare-earth element in an amount of less than 40% by volume and the balance being an iron-containing material that contains Fe. In each of the magnetic particles, a phase of the hydride of the rare-earth element is adjacent to a phase of the iron-containing material, and an interval between adjacent phases of the hydride of the rare-earth element with the phase of the iron-containing material provided therebetween is 3 μm or less.

The powder for a magnet according to the present invention may be produced by a method for producing a powder for a magnet according to the present invention as described below. The production method is a method for producing a powder for a magnet, the powder being used for a rare-earth magnet, the method including a preparation step and a hydrogenation step:

the preparation step of preparing an alloy powder composed of a rare-earth-iron-based alloy that contains a rare-earth element serving as an additional element, and the hydrogenation step of heat-treating the rare-earth-iron-based alloy powder in a hydrogen element-containing atmosphere at a temperature equal to or higher than the disproportionation temperature of the rare-earth-iron-based alloy to form a powder for a magnet, the powder being constituted by magnetic particles described below.

Each of the magnetic particles contains a hydride of a rare-earth element in an amount of less than 40% by volume and the balance being an iron-containing material that contains Fe, in which a phase of the hydride of the rare-earth element is adjacent to a phase of the iron-containing material, and an interval between adjacent phases of the hydride of the rare-earth element with the phase of the iron-containing material provided therebetween is 3 μm or less.

Each of the magnetic particles constituting the powder for a magnet according to the present invention is not composed of a single-phase rare-earth alloy, e.g., an R—Fe—B-based alloy or an R—Fe—N-based alloy, but is composed of a plurality of phases including the phase of iron-containing material, e.g., Fe or an Fe compound, and the phase of the hydride of the rare-earth element. The phase of the iron-containing material is soft and thus has satisfactory formability, compared with the R—Fe—B-based alloy, the R—Fe—N-based alloy, and the hydride of the rare-earth element. Furthermore, each of the magnetic particles constituting the powder for a magnet according to the present invention contains the iron-containing material containing Fe (pure iron) as a main component (60% by volume or more). In this case, when the powder according to the present invention is subjected to compacting, the phase of the iron-containing material, such as an Fe phase, can be sufficiently deformed. Moreover, the phase of the iron-containing material is present between the phases of the hydride of the rare-earth element as described above. That is, the phase of the iron-containing material is not unevenly distributed but is uniformly present. Thus, the deformation of each magnetic particle is uniformly performed during compacting. Thus, the use of the powder according to the present invention enables us to form a powder compact having a high relative density. Furthermore, the use of the powder compact having a high relative density results in a rare-earth magnet having a high magnetic phase content without sintering. Moreover, the sufficient deformation of the iron-containing material, such as Fe, binds the magnetic particles to each other, thus providing a rare-earth magnet having a magnetic phase content of 80% by volume or more and preferably 90% by volume or more, unlike a bond magnet which includes a binder resin.

The powder compact formed by compacting the powder for a magnet according to the present invention is not subjected to sintering, unlike a sintered magnet. Hence, there is no limitation of the shape attributed to anisotropic shrinkage caused during sintering, and so the powder compact has a high degree of flexibility in shape. Thus, the use of the powder for a magnet according to the present invention substantially eliminates the need for cutting work even for a complex shape, for example, a cylindrical shape, a columnar shape, or a pot-like shape, and facilitates the formation. Furthermore, the elimination of the need for cutting work significantly improves the yield of the material and improves the productivity of a rare-earth magnet.

The powder for a magnet according to the present invention can be easily produced by heat-treating the rare-earth-iron-based alloy powder in a hydrogen-containing atmosphere at a specific temperature as described above. In this heat treatment, the rare-earth element and the iron-containing material (e.g., Fe) in the rare-earth-iron-based alloy are separated from each other, and the rare-earth element is bonded to hydrogen.

According to an embodiment of the present invention, the rare-earth may be Sm.

According to this embodiment, it is possible to provide a rare-earth magnet having excellent magnet properties and being composed of a Sm—Fe—N-based alloy.

According to an embodiment of the present invention, the phase of the hydride of the rare-earth element may be granular, and the granular hydride of the rare-earth element may be dispersed in the phase of the iron-containing material.

According to this embodiment, the uniform presence of the iron-containing material around the grains of the hydride of the rare-earth element facilitates the deformation of the iron-containing material and is likely to lead to a high-density powder compact having a relative density of 85% or more, even 90% or more, and particularly 95% or more.

According to an embodiment of the present invention, an antioxidation layer may be provided on the surface of each of the magnetic particles, the antioxidation layer having an oxygen permeability coefficient (30° C.) of less than $1.0\times10^{-11}$ $m^3\cdot m/(s\cdot m^2\cdot Pa)$. In particular, the antioxidation layer may include a low-oxygen-permeability layer composed of a material having an oxygen permeability coefficient (30° C.)

of less than $1.0\times10^{-11}$ $m^3\cdot m/(s\cdot m^2\cdot Pa)$ and a low-moisture-permeability layer composed of a material having a moisture permeability coefficient (30° C.) of less than $1000\times10^{-13}$ kg/(m·s·MPa).

The magnetic particles contain the rare-earth element that is likely to be oxidized. According to the foregoing embodiment, even when compacting is performed to form newly formed surfaces in an environment that is likely to lead to oxidation, the antioxidation layer effectively inhibits the oxidation of the newly formed surfaces. Furthermore, in the embodiment in which both of the low-oxygen-permeability layer and the low-moisture-permeability layer are provided, even when compacting is performed in a highly humid environment, the presence of the low-moisture-permeability layer effectively inhibits the oxidation of the magnetic particles due to the contact of the moisture in the atmosphere and the newly formed surfaces.

According to an embodiment of the present invention, the magnetic particles may have an average particle size of 10 μm to 500 μm.

According to this embodiment, a relatively large average particle size of 10 μm or more results in a relative reduction in the proportion of the hydride of the rare-earth element on the surface of each magnetic particle (hereinafter, referred to as "occupancy"). As described above, the rare-earth element is commonly likely to be oxidized. However, the powder having the foregoing average particle size is less likely to be oxidized because of its low occupancy and can be handled in air. Thus, according to this embodiment, for example, the powder compact can be formed in air, leading to excellent productivity of the powder compact. Furthermore, the powder for a magnet according to the present invention has excellent formability because of the presence of the phase of the iron-containing material as described above. Thus, for example, even in the case of a relatively coarse powder having an average particle size of 100 μm or more, it is possible to form a powder compact having low porosity and a high relative density. An average particle size of 500 μm or less results in the inhibition of a reduction in the relative density of the powder compact. The average particle size is more preferably in the range of 50 μm to 200 μm.

The powder for a magnet according to the present invention may be suitably used as a raw material for a powder compact. For example, the powder compact according to the present invention is used as a raw material for a rare-earth magnet. The powder compact may be produced by compacting the powder according to the present invention, the powder compact having a relative density of 85% or more.

The powder for a magnet according to the present invention has excellent formability as described above, thus providing the high-density powder compact as described in the foregoing embodiment. Furthermore, a rare-earth magnet having a high magnetic phase content is made from the powder compact according to the foregoing embodiment.

The powder compact according to the present invention may be preferably used as a raw material for a rare-earth-iron-based alloy material. For example, the rare-earth-iron-based alloy material according to the present invention is used as a raw material for a rare-earth magnet and may be produced by heat-treating the powder compact according to the present invention in an inert gas atmosphere or a reduced atmosphere. The rare-earth-iron-based alloy material according to the present invention may be produced by, for example, a method for producing a rare-earth-iron-based alloy material according to the present invention. The method for producing a rare-earth-iron-based alloy material according to the present invention relates to a method for producing a rare-earth-iron-based alloy material used for a rare-earth magnet. The method includes a compacting step of compacting the powder for a magnet made by the foregoing method for producing a powder for a magnet according to the present invention to form a powder compact having a relative density of 85% or more, and a dehydrogenation step of heat-treating the powder compact in an inert atmosphere or a reduced atmosphere at a temperature equal to or higher than the recombination temperature of the powder compact to form the rare-earth-iron-based alloy material.

The heat treatment (dehydrogenation) removes hydrogen from the hydride of the rare-earth element in the magnetic particles constituting the powder compact and combines the phase of the iron-containing material with the rare-earth element whose hydrogen has been removed, thereby providing the rare-earth-iron-based alloy material. The resulting rare-earth-iron-based alloy material according to the present invention may be suitably used as a material for a rare-earth magnet having a high magnetic phase content and excellent magnetic properties, by the use of the high-density powder compact.

The rare-earth-iron-based alloy material according to the present invention may be suitably used as a raw material for a rare-earth-iron-nitrogen-based alloy material. For example, the rare-earth-iron-nitrogen-based alloy material according to the present invention is used as a raw material for a rare-earth magnet and may be produced by heat-treating the rare-earth-iron-based alloy material according to the present invention in a nitrogen element-containing atmosphere. This rare-earth-iron-nitrogen-based alloy material according to the present invention may be produced by, for example, a method for producing a rare-earth-iron-nitrogen-based alloy material according to the present invention. The method for producing a rare-earth-iron-nitrogen-based alloy material according to the present invention relates to a method for producing a rare-earth-iron-nitrogen-based alloy material used for a rare-earth magnet and includes a nitriding step of heat-treating the rare-earth-iron-based alloy material made by the foregoing method for producing a rare-earth-iron-based alloy material according to the present invention in a nitrogen element-containing atmosphere at a temperature from the nitriding temperature to the nitrogen disproportionation temperature of the rare-earth-iron-based alloy to form a rare-earth-iron-nitrogen-based alloy material.

The heat treatment (nitriding) combines the rare-earth-iron-based alloy with nitrogen to form the rare-earth-iron-nitrogen-based alloy material. The resulting rare-earth-iron-nitrogen-based alloy material according to the present invention may be appropriately polarized and suitably used as a rare-earth magnet. As described above, the rare-earth-iron-based alloy material is produced from the high-density powder compact, so that the resulting rare-earth magnet has a high magnetic phase content and excellent magnet properties.

In the rare-earth-iron-based alloy material according to an embodiment of the present invention, the rate of volume change between the powder compact before the heat treatment (dehydrogenation) and the rare-earth-iron-based alloy material after the heat treatment (dehydrogenation) may be 5% or less. Furthermore, in the rare-earth-iron-nitrogen-based alloy material according to an embodiment of the present invention, the rate of volume change between the rare-earth-iron-based alloy material before the heat treatment (nitriding) and the rare-earth-iron-nitrogen-based alloy material after the heat treatment (nitriding) may be 5% or less.

As described above, the use of the high-density powder compact provides the rare-earth-iron-based alloy material and the rare-earth-iron-nitrogen-based alloy material as described in the foregoing embodiments, in which each of the alloy materials reveals a small change in volume before and after the heat treatment (dehydrogenation) or the heat treatment (nitriding), i.e., each of the alloy materials has a net shape. The fact that each of the alloy materials has net shape eliminates the need for or simplifies processing (e.g., cutting or cutting work) to form a desired shape. According to the foregoing embodiments, a rare-earth magnet is produced with high productivity. In particular, in the case where the change in volume is small before and after each of the heat treatments (dehydrogenation and nitriding), the processing, such as cutting, to form a final shape may be omitted or simplified.

In the rare-earth-iron-nitrogen-based alloy material according to an embodiment of the present invention, a rare-earth-iron-nitrogen-based alloy constituting the rare-earth-iron-nitrogen-based alloy material may be a Sm—Fe—Ti—N alloy.

Examples of the rare-earth-iron-nitrogen-based alloy constituting the rare-earth-iron-nitrogen-based alloy material that may be used for a rare-earth magnet include Sm—Fe—N alloys, more specifically, $Sm_2Fe_{17}N_3$. An example of the rare-earth-iron-based alloy constituting the rare-earth-iron-based alloy material used as the raw material therefor is $Sm_2Fe_{17}$. To subject $Sm_2Fe_{17}$ to nitriding into $Sm_2Fe_{17}N_3$, it is necessary to accurately control the proportion of nitrogen. It is desired to improve the productivity of the rare-earth-iron-nitrogen-based alloy material.

In contrast, in the case where the rare-earth-iron-nitrogen-based alloy material is composed of a Sm—Ti—Fe—N alloy, more specifically, $Sm_1Fe_{11}Ti_1N_1$ and where the rare-earth-iron-based alloy material used as a raw material therefor is composed of $Sm_1Fe_{11}Ti_1$, the nitriding treatment of $Sm_1Fe_{11}Ti_1$ is performed stably and uniformly, thus leading to excellent productivity of the rare-earth-iron-nitrogen-based alloy material.

Furthermore, in $Sm_1Fe_{11}Ti_1$, the ratio of the iron-containing components, Fe and FeTi, to the rare-earth element, Sm, is higher than that in $Sm_2Fe_{17}$. Specifically, in $Sm_2Fe_{17}$, Sm:Fe=2:17. In contrast, in $Sm_1Fe_{11}Ti_1$, Sm:Fe:Ti=1:11:1, i.e., Sm:(Fe+FeTi)=1:12. Thus, in the case where a powder including magnetic particles each containing a phase of the iron-containing material that contains Fe and an FeTi compound and a phase of a hydride of Sm is used as a raw-material powder for the production of the rare-earth-iron-based alloy material having a composition of $Sm_1Fe_{11}Ti_1$, a large amount of the iron-containing components having good formability results in excellent formability. In addition, the use of the powder enables us to form a high-density powder compact stably and easily. Furthermore, the use of the Ti-containing material leads to a reduction in the amount of Sm, which is a scarce resource. From the foregoing findings, the inventors propose the Sm—Ti—Fe—N alloy as the rare-earth-iron-nitrogen-based alloy material.

According to the foregoing embodiments, as described above, excellent formability of the powder compact and excellent stability during the nitriding treatment are provided, thus leading to excellent productivity. Furthermore, according to the foregoing embodiments, as described above, the rare-earth magnet having a high magnetic phase content and excellent magnet properties is produced by the use of the high-density powder compact.

According to an embodiment of the present invention, the rare-earth element may be Sm, and the iron-containing material may contain Fe and an FeTi compound.

According to this embodiment, as described above, the amount of the iron-containing material (Fe and the FeTi compound (intermetallic compound)) is relatively larger than that of the rare-earth element Sm, thus leading to excellent formability and enabling us to form the powder compact having a relative density of, for example, 90% or more. Furthermore, according to this embodiment, as described above, the nitriding treatment is performed stably and uniformly. Thus, the use of the powder for a magnet according to the embodiment of the present invention provides a rare-earth magnet having a high magnetic phase content and suppresses variations in magnet properties due to variations in nitrogen content, thereby enabling us to stably produce a rare-earth magnet having excellent magnet properties with high productivity.

In the powder compact according to an embodiment of the present invention, the powder compact having a relative density of 90% or more may be produced by compacting the powder according to the present invention, in which the rare-earth element may be Sm, and the iron-containing material may contain Fe and the FeTi compound.

According to the embodiment, as described above, the nitriding treatment is stably and uniformly performed throughout the entire powder compact, thereby producing a rare-earth magnet having a high magnetic phase content and reduced variations in magnet properties due to the variations in nitrogen content. Thus, the powder compact may be suitably used as a material for the magnet. Furthermore, according to the embodiment, the powder compact may contribute to improvement in the productivity of the rare-earth magnet having excellent magnet properties.

In the method for producing a powder for a magnet according to an embodiment of the present invention, the rare-earth-iron-based alloy may be a Sm—Fe—Ti alloy.

According to the embodiment, by performing the hydrogenation step, the Sm—Fe—Ti alloy may be separated into a hydride of Sm and the iron-containing material that contains Fe and an Fe—Ti alloy, thus providing the powder for a magnet as described above, the powder having a relatively high iron-containing component content and thus excellent formability. Furthermore, the use of the resulting powder for a magnet provides the high-density powder compact as described above. In addition, when the powder compact is subjected to the dehydrogenation heat treatment and then the nitriding treatment, the nitriding treatment is performed stably and uniformly.

In the method for producing a rare-earth-iron-nitrogen-based alloy material according to an embodiment of the present invention, the nitriding treatment may be performed under a pressure of 100 MPa or more.

According to the embodiment, in the case where the nitriding treatment is performed under pressure, the temperature of the nitriding treatment can be reduced. It is thus possible to prevent the formation of iron nitride and a nitride of the rare-earth element due to the decomposition of the rare-earth-iron-based alloy into the iron element and the rare-earth element. That is, it is possible to effectively prevent the formation of a nitride other than a target nitride, i.e., the rare-earth-iron-nitrogen-based alloy material. Hence, according to the embodiment, the pressurization can reduce the heat-treatment temperature for forming a target rare-earth-iron-nitrogen compound, so that the elements constituting the rare-earth-iron-based alloy, which is an object subjected to the nitriding treatment, can be reduced in reactivity to the nitriding, thus preventing the reduction in magnet properties due to the formation of unnecessary nitride.

Advantageous Effects of Invention

A powder for a magnet according to the present invention has excellent formability and provides a powder compact according to the present invention, the powder compact having a high relative density. The use of the powder compact according to the present invention, a rare-earth-iron-based alloy material according to the present invention, and a rare-earth-iron-nitrogen-based alloy material according to the present invention provides a rare-earth magnet having a high magnetic phase content. A method for producing a powder for a magnet according to the present invention, a method for producing a rare-earth-iron-based alloy material according to the present invention, and a method for producing a rare-earth-iron-nitrogen-based alloy material according to the present invention provide the powder for a magnet according to the present invention, the rare-earth-iron-based alloy material according to the present invention, and the rare-earth-iron-nitrogen-based alloy material according to the present invention with high productivity.

DESCRIPTION OF EMBODIMENTS

Figure 1:
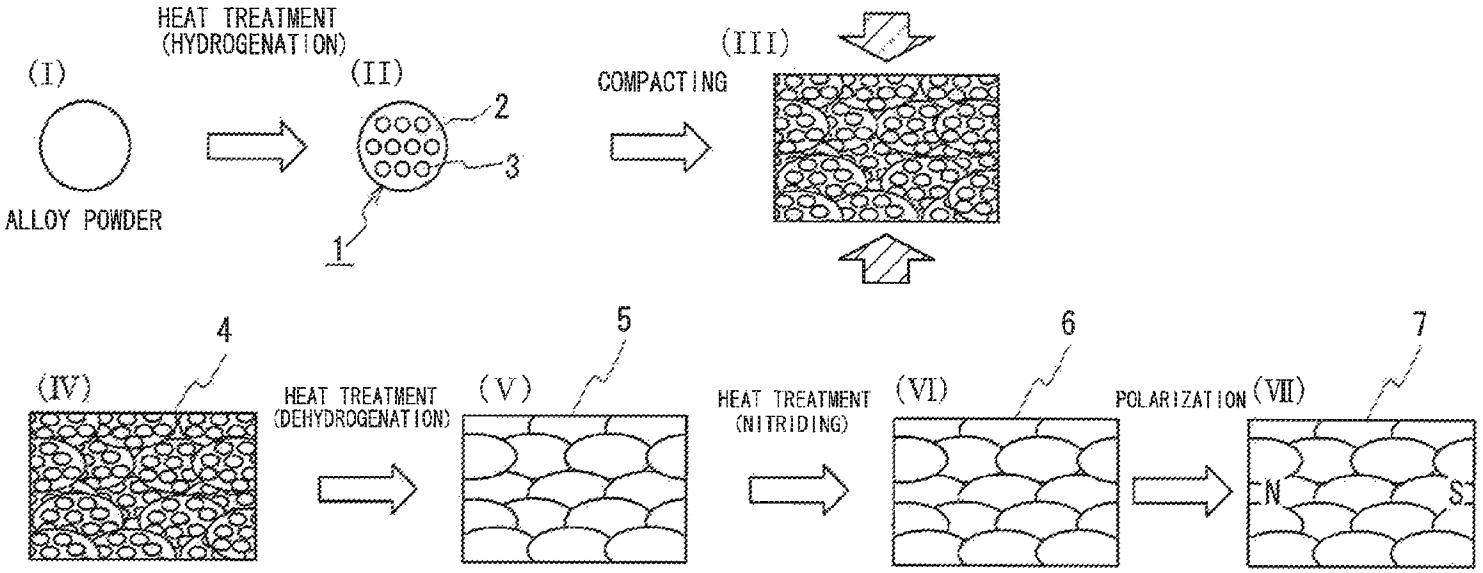
FIG. 1 is an explanatory process drawing illustrating an exemplary process for making a magnet from a powder for a magnet according to the present invention, the powder being produced in Test Example 1.

The present invention will be described in detail below.

[Powder for Magnet]

Magnetic particles constituting a powder for a magnet according to the present invention each contain an iron-containing material as a main component. Each of the magnetic particles has an iron-containing material content of 60% by volume or more. An iron-containing material content of less than 60% by volume results in a relative increase in the amount of a hydride of a rare-earth element, thus causing difficulty in sufficiently deforming the iron-containing material during compacting. An excessively high iron-containing material content leads ultimately to a reduction in magnet properties. Thus, the magnetic particles have an iron-containing material content of 90% by volume or less.

The iron-containing material is composed of a material consisting of Fe (pure iron) alone; a material in which Fe is partially substituted with at least one element selected from Co, Ga, Cu, Al, Si, and Nb and which contains Fe and the substitution element; a material that contains Fe and an Fe-containing compound (e.g., FeTi compound); and a material that contains Fe, the substitution element, and the iron compound. In the case where the iron-containing material is composed of the material containing the substitution element, the magnetic properties and corrosion resistance can be improved. In the case where the iron-containing material is composed of the material containing the iron compound, such as FeTi, the following beneficial effects are provided as described above: (1) The iron-containing material content is relatively increased with respect to a rare-earth element to provide a high-density powder compact having excellent formability; (2) nitriding treatment after dehydrogenation heat treatment can be stably performed; and (3) ultimately, a rare-earth magnet having a high magnetic phase content and excellent magnet properties is provided. The abundance ratio of iron to the iron compound and so forth in the iron-containing material is determined by, for example, measuring peak intensities (peak areas) in X-ray diffraction and comparing the measured peak intensities. The abundance ratio can be adjusted by appropriately changing the composition of a rare-earth-iron-based alloy serving as a raw material for a powder for a magnet according to the present invention.

Meanwhile, if the hydride of the rare-earth element is not contained, the rare-earth magnet is not obtained. Thus, the proportion of the hydride of the rare-earth element is more than 0% by volume or more, preferably 10% by volume or more, and less than 40% by volume. The proportion of the iron-containing material and the proportion of the hydride of the rare-earth element can be adjusted by appropriately changing the composition of the rare-earth-iron-based alloy serving as a raw material for the powder for a magnet according to the present invention and heat-treatment conditions (mainly temperature) during the production of the powder. Note that the magnetic particles constituting the powder for a magnet are permitted to contain incidental impurities.

The rare-earth element contained in each magnetic particle is at least one element selected from Sc (scandium), Y (yttrium), lanthanoids, and actinoid. In particular, in the case of Sm (samarium), which is a lanthanoid, a rare-earth magnet, which has excellent magnet properties, composed of a Sm—Fe—N-based alloy is obtained. In the case where another rare-earth element is contained in addition to Sm, for example, at least one element of Pr, Dy, La, and Y is preferred. An example of the hydride of the rare-earth element is $SmH_2$.

Each of the magnetic particles has a texture in which a phase of the hydride of the rare-earth element and a phase of iron-containing material are uniformly dispersed. The dispersed state indicates that in each magnetic particle, the phase of the hydride of the rare-earth element and the phase of the iron-containing material are adjacent to each other and that an interval between adjacent phases of the hydride of the rare-earth element with the phase of the iron-containing material provided therebetween is 3 μm or less. Typical examples thereof include a layered configuration in which each of the phases has a multilayer structure; and a granular configuration in which the phase of the hydride of the rare-earth element is granular, the phase of the iron-containing material serves as a matrix phase, and the granular hydride of the rare-earth element is dispersed in the matrix phase.

The configurations of both the phases depend on the heat-treatment conditions (mainly temperature) during the production of the powder for a magnet according to the present invention. When the temperature is increased, the granular configuration tends to be obtained. When the temperature is set to a disproportionation temperature, the layered configuration tends to be obtained.

The use of the powder having the layered configuration makes it possible to produce, for example, a rare-earth magnet having a magnetic-phase content (about 80% by volume) comparable to that of a bond magnet without a binder resin. Note that in the case of the layered configuration, "the phase of the hydride of the rare-earth element and the phase of the iron-containing material are adjacent to each other" indicates a state in which the phases are substantially alternately stacked in a cross section of each of the magnetic particles. Furthermore, in the case of the layered configuration, "the interval between adjacent phases of the hydride of the rare-earth element" indicates in the cross section, a distance between the centers of two adjacent phases of the hydride of the rare-earth element with the phase of the iron-containing material provided therebetween.

For the granular configuration, the iron-containing material is uniformly present around grains of the hydride of the rare-earth element and thus is easily deformed compared with the layered configuration. For example, a powder compact having a complex shape, e.g., a cylindrical shape, a columnar shape, or a pot-like shape, and a powder compact having a high relative density of 85% or more, further 90% or more, and particularly 95% or more are easily produced. Note that in the case of the granular configuration, "the phase of the hydride of the rare-earth element and the phase of the iron-containing material are adjacent to each other" typically indicates a state in which in the cross section of each of the magnetic particles, the iron-containing material is present so as to cover the periphery of each of the grains of the hydride of the rare-earth element and in which the iron-containing material is present between adjacent grains of the hydride of the rare-earth element. Furthermore, in the case of the granular configuration, "the interval between adjacent phases of the hydride of the rare-earth element" indicates in the cross section, a distance between the centers of two adjacent grains of the hydride of the rare-earth element.

The interval can be measured by, for example, etching the cross section to remove the phase of the iron-containing material and then extracting the hydride of the rare-earth element; removing the hydrate of the rare-earth element and then extracting the iron-containing material, depending on the type of solution; or analyzing the composition of the cross section with an energy dispersive X-ray (EDX) spectrometer. An interval of 3 μm or less results in the elimination of the need for excessive input energy when a powder compact made from the powder is appropriately subjected to heat treatment to convert the mixed texture of the hydride of the rare-earth element and the iron-containing material into a rare-earth-iron-based alloy and to form a rare-earth-iron-based alloy material, and results in the inhibition of a reduction in properties due to an increase in the crystal size of the rare-earth-iron-based alloy. The interval is preferably 0.5 μm or more and particularly preferably 1 μm or more in order that the iron-containing material may be sufficiently present between the phases of the hydride of the rare-earth element. The interval can be adjusted by, for example, adjusting the composition of the rare-earth-iron-based alloy used as a raw material or specifying the heat-treatment conditions during the production of the powder for a magnet, in particular, setting the temperature within the specified range. For example, when the iron content (atomic ratio) of the rare-earth-iron-based alloy is increased or when the temperature during the heat treatment (hydrogenation) is increased under the specific conditions, the interval tends to increase.

Each of the magnetic particles has a configuration with a circularity of 0.5 to 1.0 in the cross section. A circularity within the above range provides the following effects and is thus preferred: (1) An antioxidation layer, an insulating coating, and so forth described below are likely to be formed so as to have uniform thicknesses, and (2) breaks of the antioxidation layer, the insulating coating, and so forth can be suppressed during compacting. The magnetic particles closer to being spherical, i.e., the magnetic particles having a circularity closer to 1, provide the foregoing effects. The measurement method of the circularity is described below.

<<Antioxidation Layer>>

The powder according to the present invention contains a rare-earth element, which is likely to be oxidized. For example, in the case where compacting is performed in an oxygen-containing atmosphere, such as an air atmosphere, newly formed surfaces of the magnetic particles by the compacting are oxidized. The presence of the formed oxide may lead to a reduction in the proportion of the magnetic phase in a magnet ultimately produced. In contrast, in the case of the configuration in which the foregoing antioxidation layer is provided to cover the entire surface of each of the magnetic particles, each magnetic particle can be sufficiently kept away from oxygen in the atmosphere to prevent the oxidation of the newly formed surface of each magnetic particle. To provide this effect, a lower oxygen permeability coefficient (30° C.) of the antioxidation layer is preferred. The oxygen permeability coefficient is preferably less than $1.0\times10^{-11}$ $m^3\cdot m/(s\cdot m^2\cdot Pa)$ and particularly preferably $0.01\times10^{-11}$ $m^3\cdot m/(s\cdot m^2\cdot Pa)$ or less. The lower limit is not set.

Furthermore, the antioxidation layer preferably has a moisture permeability coefficient (30° C.) of less than $1000\times10^{-13}$ kg/(m·s·MPa). In general, for a moisture-containing atmosphere, such as an air atmosphere, there can be a humid state (e.g., at an air temperature of about 30° C. and a humidity of about 80%) in which a relatively large amount of moisture (typically, water vapor) is present. The newly formed surfaces of the magnetic particles may come into contact with the moisture and thus be oxidized. Accordingly, in the case where the antioxidation layer also has a low-moisture-permeability coefficient, the oxidation due to moisture can be effectively prevented. A lower moisture permeability coefficient is preferred. The coefficient of moisture permeability is more preferably $10\times10^{-13}$ kg/(m·s·MPa) or less. The lower limit is not set.

The antioxidation layer may be composed of any of various materials having oxygen permeability coefficients and moisture permeability coefficients that satisfy the above range. Examples of the materials include resins, ceramics (with impermeability to oxygen), metals, and vitreous materials. The antioxidation layer composed of a resin has the following effects: (1) it is possible to sufficiently follow the deformation of each of the magnetic particle during compacting to effectively prevent the exposure of the newly formed surface of each magnetic particle during the deformation, and (2) the resin can be eliminated at the time of heat treatment of the powder compact to suppress a reduction in the proportion of the magnetic phase due to residues of the antioxidation layer. The antioxidation layer composed of a ceramic or metal is highly effective in preventing the oxidation. The antioxidation layer composed of vitreous material can also function as an insulating coating film as described below.

The antioxidation layer may have a single- or multi-layer configuration. For example, the antioxidation layer may have a single-layer configuration consisting of only a low-oxygen-permeability layer composed of a material having an oxygen permeability coefficient (30° C.) of less than $1.0\times10^{-11}$ $m^3\cdot m/(s\cdot m^2\cdot Pa)$ or a multilayer configuration in which the low-oxygen-permeability layer and a low-moisture-permeability layer are stacked as described above.

A resin that may be used as a material constituting the low-oxygen-permeability layer is one selected from polyamide resins, polyester, and polyvinyl chloride. A typical example of polyamide resins is nylon 6. Nylon 6 has an oxygen permeability coefficient (30° C.) as very low as $0.0011\times10^{-11}$ $m^3\cdot m/(s\cdot m^2\cdot Pa)$ and is preferred. Examples of a resin that may be used as a material constituting the low-moisture-permeability layer include polyethylene, fluorocarbon resins, and polypropylene. Polyethylene has a moisture permeability coefficient (30° C.) as very low as $7\times10^{-13}$ kg/(m·s·MPa) to $60\times10^{-13}$ kg/(m·s·MPa) and is preferred.

In the case where the antioxidation layer has a two-layer structure including the low-oxygen-permeability layer and the low-moisture-permeability layer, either layer may be arranged inside (on the side of the magnetic particle) or outside (surface side). In the case where the low-oxygen-permeability layer is arranged inside and where the low-moisture-permeability layer is arranged outside, the oxidation should be more effectively prevented. Furthermore, in the case where both of the low-oxygen-permeability layer and the low-moisture-permeability layer are composed of resins as described above, excellent adhesion between both layers is obtained, which is preferred.

The thickness of the antioxidation layer may be appropriately selected. An excessively small thickness fails to provide a sufficient antioxidation effect. An excessively large thickness leads to a reduction in the density of a powder compact. For example, it is difficult to form a powder compact having a relative density of 85% or more and remove the layer by firing. Thus, the thickness of the antioxidation layer is preferably in the range of 10 nm to 1000 nm. In particular, the thickness of the antioxidation layer is a thickness two or less times the diameter of each magnetic particle. Furthermore, a thickness of 100 nm to 300 nm results in the inhibition of the oxidation and a reduction in density and excellent formability and is thus preferred. In the case where the antioxidation layer has a multilayer structure, such as the two-layer structure as described above, the thickness of each layer is preferably in the range of 10 nm to 500 nm.

<<Insulating Coating>>

The powder for a magnet according to the present invention may have a configuration in which each of the magnetic particles further includes an insulating coating composed of an insulating material on its surface. The use of the powder including the insulating coating provides a rare-earth magnet with high electrical resistance. For example, the use of the magnet for a motor reduces eddy current loss. Examples of the insulating coating include crystalline coatings composed of oxides of Si, Al, Ti, and so forth; amorphous glass coating; and coatings composed of ferrite Me—Fe—O (Me represents a metal element, for example, Ba, Sr, Ni, or Mn), magnetite ($Fe_3O_4$), metal oxides, such as $Dy_2O_3$, resins, such as silicone resins, and oxides, such as silsesquioxane compounds. To improve the thermal conductivity, a Si—N— or Si—C-based ceramic coating may be provided. The crystalline coatings, the glass coatings, the oxide coatings, ceramic coatings, and so forth may have the function of preventing oxidation. In this case, the magnetic particles can be prevented from oxidation. Furthermore, the arrangement of the coating having the function of preventing oxidation in addition to the foregoing antioxidation layer further results in the prevention of the oxidation of the magnetic particles.

In the configuration including the insulating coating, the ceramic coating, and the antioxidation layer, preferably, the insulating coating is arranged so as to be in contact with the surface of each magnetic particle, and the ceramic coating and the antioxidation layer are arranged thereon.

[Production Method]

<<Preparation Step>>

For example, a powder composed of the rare-earth-iron-based alloy (e.g., $Sm_2Fe_{17}$ or $Sm_1Fe_{11}$ $Ti_1$) serving as a raw material for the powder for a magnet may be produced by grinding ingots made by melting and casting or foil made by rapid solidification with a grinding apparatus, e.g., a jaw crusher, a jet mill, or a ball mill, the ingots and the foil being composed of a desired rare-earth-iron-based alloy, or by employing an atomizing process, such as a gas atomizing process. In particular, in the case where the gas atomizing process is employed, the formation of a powder in a nonoxidative atmosphere enables the powder to contain substantially no oxygen (oxygen concentration: 500 ppm by mass or less). That is, the fact that particles constituting the powder composed of the rare-earth-iron-based alloy have an oxygen concentration of 500 ppm by mass or less may serve as an index that indicates that the powder has been produced by the gas atomizing process in a nonoxidative atmosphere. To produce the powder composed of the rare-earth-iron-based alloy, a known production method may be employed. Alternatively, a powder produced by the atomizing process may further be pulverized. Appropriate modifications of grinding conditions and production conditions enable us to adjust the particle size distribution and the shape of the particles of the powder for a magnet. For example, the employment of the atomizing process is likely to produce a powder having high sphericity and excellent filling properties at the time of compacting. Each of the particles constituting the rare-earth-iron-based alloy powder may be composed of a polycrystalline substance or a single-crystal substance. Polycrystalline particles may be appropriately heat-treated into single-crystal particles.

With respect to the size of the rare-earth-iron-based alloy powder prepared in the preparation step, in the case where the subsequent step, i.e., the heat treatment for hydrogenation, is performed so as not to substantially change the size during the heat treatment, the size is maintained, so that the size is substantially equal to that of the powder for a magnet according to the present invention. The powder according to the present invention has a specific texture as described above and thus excellent formability. Hence, for example, relatively coarse magnetic particles having an average particle size of about 100 μm can be formed. Therefore, the rare-earth-iron-based alloy powder having an average particle size of about 100 μm can be used. For example, such a coarse alloy powder can be produced by only coarse-grinding ingots made by melting and casting, or by an atomizing process, such as a molten-metal atomizing process. Here, for sintered magnets and bond magnets, fine particles each having a particle size of 10 μm or less have been used as raw-material powders constituting compacts before sintering and as raw-material powders mixed with resins. The use of the foregoing coarse alloy powder eliminates the need for fine grinding to reduce the number of production steps, thereby leading to a reduction in production cost.

For the heat treatment for hydrogenation described below, a common furnace may be used. In addition, we have found that when a rocking furnace, such as a rotary kiln, is used, the rare-earth-iron-based alloy serving as a raw material collapses into fine particles with hydrogenation. Accordingly, it is possible to use a very coarse rare-earth-iron-based alloy having an average particle size on the order of several millimeters to 10-odd millimeters as a raw material for the powder for a magnet according to the present invention. The use of such a coarse raw material enables us to omit the foregoing grinding step or reduce the length of time required for the grinding step, thereby leading to a further reduction in production cost.

<<Hydrogenation Step>>

In a hydrogenation step, examples of the hydrogen element-containing atmosphere include one atmosphere of hydrogen ($H_2$) alone and a mixed atmosphere of hydrogen ($H_2$) and an inert gas, e.g., Ar or $N_2$. A heat-treatment temperature in the hydrogenation step is set to a temperature equal to or higher than a temperature at which the disproportionation reaction of the rare-earth-iron-based alloy proceeds, i.e., a disproportionation temperature. The disproportionation reaction indicates a reaction in which the preferential hydrogenation of the rare-earth element results in the separation of a rare-earth hydride from Fe (or Fe and an iron compound). The lower temperature limit at which the reaction occurs is referred to as a "disproportionation temperature". The disproportionation temperature varies depending on the composition of the rare-earth-iron-based alloy and the type of rare-earth element. For example, in the case where the rare-earth-iron-based alloy is $Sm_2Fe_{17}$ or $Sm_1Fe_{11}Ti_1$, the disproportionation temperature is 600° C. or higher. In the case where the temperature of the heat treatment for hydrogenation is set at a temperature in the vicinity of the disproportionation temperature, the layered configuration is likely to be formed. In the case where the temperature of the heat treatment for hydrogenation is set at a temperature at least 100° C. higher than the disproportionation temperature, the foregoing granular configuration is likely to be formed. A higher heat-treatment temperature in the hydrogenation step is likely to allow the Fe phase to serve as a matrix, so that a hard hydride of the rare-earth element precipitated simultaneously with Fe is less likely to serve as an inhibitory factor in inhibiting the deformation, thereby enhancing the formability of the powder for a magnet. An excessively high temperature causes failures, such as melting and sticking of the powder. Thus, the temperature is preferably 1100° C. or lower. In particular, in the case where the rare-earth-iron-based alloy is $Sm_2Fe_{17}$ or $Sm_1Fe_{11}Ti_1$, a relatively low heat-treatment temperature in the hydrogenation step of 700° C. to 900° C. results in a fine texture with a small interval. The use of such a powder is likely to lead to the formation of a rare-earth magnet having a high coercive force. The holding time is in the range of 0.5 hours to 5 hours. The heat treatment corresponds to treatment from the initial step to the disproportionation step in the foregoing HDDR treatment. Known disproportionation conditions may be applied.

<<Coating Step>>

In the case of forming the configuration in which the antioxidation layer is provided on the surface of each of the magnetic particles, the antioxidation layer is formed on each of the magnetic particles obtained by the hydrogenation step. Any of dry and wet processes may be employed to form the antioxidation layer. In the dry process, a nonoxidative atmosphere, such as an inert atmosphere, e.g., Ar or $N_2$, or a reduced-pressure atmosphere, is preferably used in order to prevent the magnetic particles from coming into contact with oxygen in the atmosphere. In the wet process, the surfaces of the magnetic particles are not substantially in contact with oxygen in the atmosphere. This eliminates the need for the foregoing inert atmosphere or the like. For example, the antioxidation layer may be formed in an air atmosphere. Accordingly, the wet process is preferred because the wet process is excellent in workability in the formation of the antioxidation layer and is likely to form the antioxidation layer having a uniform thickness on the surface of each of the magnetic particles.

For example, in the case where the antioxidation layer composed of a resin or a vitreous material is formed by the wet process, a wet-dry coating method or a sol-gel method may be employed. More specifically, a powder to be coated is mixed with a solution prepared by, for example, dissolving and mixing a raw material in an appropriate solvent. Curing the raw material and evaporating the solvent result in the formation of the antioxidation layer. In the case where the antioxidation layer composed of a resin is formed by the dry process, for example, powder coating may be employed. In the case where the antioxidation layer composed of a ceramic or a metal is formed by the dry process, vapor deposition methods, such as a PVD method, e.g., sputtering, and a CVD method, and a mechanical alloying method may be employed. In the case where the antioxidation layer composed of a metal is formed by the wet process, various plating methods may be employed.

In the case of the configuration including the foregoing insulating coating and the ceramic coating, preferably, after the formation of the insulating coating on the surface of each of the magnetic particles, the antioxidation layer and the ceramic coating are formed.

<<Compacting Step>> and [Powder Compact]

The powder for a magnet according to the present invention is compacted into a powder compact according to the present invention. As described above, the powder according to the present invention has excellent formability. Thus, the powder compact having a high relative density (the actual density of the powder compact with respect to the true density), for example, a relative density of 85% or more, is obtained. A higher relative density ultimately results in a higher proportion of the magnetic phase. However, for the configuration including the antioxidation layer, in the case where a component of the antioxidation layer is eliminated by firing in a heat-treatment step, such as nitriding treatment, or in another heat-treatment step for removal, an excessively high relative density causes difficulty in eliminating the component of the antioxidation layer by firing. Thus, in the case where the powder compact is formed from the powder including the antioxidation layer, the powder compact preferably has a relative density of about 90% to about 95%. In the case where the relative density of the powder compact is increased, the thickness of the antioxidation layer is reduced, or another heat treatment (removal of the coating) is performed, so that the antioxidation layer is easily removed, which is preferred. In the case where the powder compact is formed from a powder that does not include the antioxidation layer, the upper limit of the relative density of the powder compact is not preferably set.

As described above, in the case where the magnetic particles constituting the powder for a magnet according to the present invention has a configuration containing a hydride of Sm and an iron-containing material that contains Fe and an FeTi compound, it is possible to stably produce a powder compact having excellent formability and a relative density of 90% or more.

The powder for a magnet according to the present invention has excellent formability. Thus, the compacting may be performed at a relatively low pressure, for example, 8 ton/$cm^2$ to 15 ton/$cm^2$. Furthermore, the powder for a magnet according to the present invention has excellent formability. Thus, even in the case of a powder compact having a complex shape, it is possible to form the powder compact. Moreover, for the powder for a magnet according to the present invention, because each of the magnetic particles can be sufficiently deformed, it is possible to form the powder compact having excellent bondability between the magnetic particles (development of strength resulting from the engagement of irregularities of the particle surfaces (what is called necking strength)) and high strength, the powder compact being less likely to collapse during the production.

In the case where the powder for a magnet according to the present invention has the configuration including the antioxidation layer, as described above, even when compacting is performed in an oxygen-containing atmosphere, such as an air atmosphere, the magnetic particles are less likely to be oxidized and thus have excellent workability. In the case of the configuration that does not including the antioxidation layer, compacting in a nonoxidative atmosphere prevents the oxidation of the magnetic particles, which is preferred.

In addition, heating a compacting die during compacting promotes the deformation, so that a high-density powder compact is likely to be formed.

<<Dehydrogenation Step>> and [Rare-Earth-Iron-Based Alloy Material]

In a dehydrogenation step, heat treatment is performed in a hydrogen-free atmosphere, which does not react with the magnetic particles, so as to efficiently remove hydrogen. Examples of the hydrogen-free atmosphere include inert atmospheres and reduced-pressure atmospheres. Examples of inert atmospheres include Ar and $N_2$. The reduced-pressure atmosphere indicates a vacuum state having a lower pressure than that of a normal air atmosphere. The ultimate degree of vacuum is preferably 10 Pa or less. In the case where hydrogen is removed from the hydride of the rare-earth element in the reduced-pressure atmosphere, the hydride of the rare-earth element is less likely to be left, so that it is possible to completely form the rare-earth-iron-based alloy. Thus, the use of the resulting rare-earth-iron-based alloy material as a raw material results in a rare-earth magnet having excellent magnetic properties.

The temperature of the dehydrogenation heat treatment is set to a temperature equal to or higher than the recombination temperature (temperature at which the separated iron-containing material and rare-earth element react) of the powder compact. The recombination temperature varies depending on the composition of the powder compact (magnetic particles) and is typically 600° C. or higher. A higher recombination temperature results in sufficient removal of hydrogen. However, an excessively high heat-treatment temperature may lead to the volatilization of the rare-earth element having a high vapor pressure to reduce the amount of the rare-earth element and may lead to coarse crystals of the rare-earth-iron-based alloy to reduce the coercive force of the rare-earth magnet. Thus, the recombination temperature is preferably 1000° C. or lower. The holding time is in the range of 10 minutes to 600 minutes. The dehydrogenation heat treatment corresponds to the DR treatment of the foregoing HDDR treatment. Known DR treatment conditions may be applied.

The rare-earth-iron-based alloy material according to the present invention produced through the dehydrogenation step has a single configuration substantially constituted by the rare-earth-iron-based alloy or a mixed configuration substantially constituted by the rare-earth-iron-based alloy and iron. For example, the single configuration has a composition substantially the same as that of the rare-earth-iron-based alloy used as a raw material for the powder for a magnet according to the present invention. In particular, the rare-earth-iron-based alloy having a composition of $Sm_2Fe_{17}$ is subjected to final nitriding treatment to form $Sm_2Fe_{17}N_3$ having excellent magnet properties and is preferred because a rare-earth magnet having excellent magnet properties is obtained. Furthermore, the rare-earth-iron-based alloy having a composition of $Sm_1Fe_{11}Ti_1$ is preferred because the final nitriding treatment is stably performed and because a rare-earth magnet having a composition of $Sm_1Fe_{11}Ti_1N_1$ with excellent magnet properties is produced with good productivity.

The mixed configuration varies depending on the composition of the rare-earth-iron-based alloy used as a raw material. For example, the use of an alloy powder having a high iron content (atomic ratio) results in a configuration in which an iron phase and a rare-earth-iron-based alloy phase are present. In a rare-earth-iron-based alloy material produced by compacting a rare-earth-iron-based alloy powder, a planar fracture surface is present in each of the powder particles constituting the alloy material. In a rare-earth-iron-based alloy material produced by hot forging, boundaries of powder particles are clearly present in the alloy material. In contrast, in the rare-earth-iron-based alloy material according to the present invention, a fracture surface and boundaries of powder particles are not substantially present.

In the case where the configuration including the antioxidation layer is used and where the antioxidation layer is composed of a removable material, such as a resin, by firing, the dehydrogenation heat treatment may also function to remove the antioxidation layer. Heat treatment (coating removal) to remove the antioxidation layer may be separately performed. The heat treatment to remove the coating may be reasonably performed at a heating temperature of 200° C. to 400° C. for a holding time of 30 minutes to 300 minutes, depending on the configuration of the antioxidation layer. In particular, for a high-density powder compact, the heat treatment to remove the coating is preferably performed to effectively prevent the formation of residues resulting from incomplete combustion due to the rapid heating of the antioxidation layer to the heating temperature of the dehydrogenation heat treatment.

In the case where the powder compact according to the present invention is used, the degree of volume change (the amount of shrinkage after the heat treatment) is low before and after the dehydrogenation heat treatment. For example, as described above, the rate of volume change may be 5% or less. As described above, the use of the powder compact according to the present invention does not result in a large change in volume and enables us to omit cutting work to adjust the shape, compared with the production of a conventional sintered magnet. Note that in the rare-earth-iron-based alloy material obtained after the dehydrogenation heat treatment, grain boundaries of the powder are observed, unlike a sintered body. That is, in the rare-earth-iron-based alloy material, the presence of the grain boundaries of the powder serves as an index that indicates that the powder compact has been subjected to heat treatment and is not a sintered body. The absence of a mark made by cutting work or the like serves as an index that indicates a low rate of volume change before and after the heat treatment.

<<Nitriding Treatment>> and [Rare-Earth-Iron-Nitrogen-Based Alloy Material]

In a nitriding step, examples of a nitrogen element-containing atmosphere include one atmosphere of nitrogen ($N_2$) alone, an ammonia ($NH_3$) atmosphere, and a mixed-gas atmosphere of nitrogen ($N_2$), ammonia, and an inert gas, such as Ar. The temperature of heat treatment in the nitriding step is in the range of a temperature at which the rare-earth-iron-based alloy reacts with a nitrogen element in the form of the alloy (nitriding temperature) to a nitrogen disproportionation temperature (a temperature at which the iron-containing material and the rare-earth element are separated and react independently with the nitrogen element). The nitriding temperature and the nitrogen disproportionation temperature vary depending on the composition of the rare-earth-iron-based alloy. For example, in the case where the rare-earth-iron-based alloy is $Sm_2Fe_{17}$ or $Sm_1Fe_{11}Ti_1$, the nitriding treatment temperature is in the range of 200° C. to 550° C. (preferably 300° C. or higher). The holding time is in the range of 10 minutes to 600 minutes. In particular, in the case where the rare-earth-iron-based alloy is $Sm_1Fe_{11}Ti_1$, it is possible to stably perform the nitriding treatment and uniformly subject the entire rare-earth-iron-based alloy material to nitriding.

In the case where the nitriding step is performed under pressure, the nitriding treatment can be stably performed as described above, and a rare-earth-iron-nitrogen-based alloy material, such as $Sm_1Fe_{11}Ti_1N_1$, can be produced with good productivity. A pressure of about 100 MPa to about 500 MPa may be reasonably applied.

The foregoing nitriding step is performed to provide the rare-earth-iron-nitrogen-based alloy material according to the present invention, e.g., an alloy material having a composition of $Sm_2Fe_{17}N_3$ or an alloy material having a composition of $Sm_1Fe_{11}Ti_1N_1$. In the rare-earth-iron-nitrogen-based alloy material obtained, as described above, by using the rare-earth-iron-based alloy material made from a compact formed by compacting the powder for a magnet, having excellent compacting properties, according to the present invention, particles constituting the alloy material each tend to have a high aspect ratio.

Furthermore, in the case where the rare-earth-iron-nitrogen-based alloy material is produced from the rare-earth-iron-based alloy material according to the present invention as described above, the degree of volume change is low before and after the nitriding treatment. For example, as described above, the rate of volume change is 5% or less. Thus, the use of the rare-earth-iron-based alloy material according to the present invention enables us to omit cutting work or the like to form a final shape. Note that also in the rare-earth-iron-nitrogen-based alloy material obtained after the nitriding treatment, grain boundaries of the powder are observed. The presence of the grain boundaries of the powder serves as an index that indicates that the rare-earth-iron-nitrogen-based alloy material has been obtained by appropriately performing heat treatment the powder compact and is not a sintered body. The absence of a mark made by cutting work or the like serves as an index that indicates a low rate of volume change before and after the heat treatment, such as the nitriding treatment.

[Rare-Earth Magnet]

The rare-earth-iron-nitrogen-based alloy material according to the present invention is appropriately polarized to produce a rare-earth magnet. In particular, the use of the foregoing powder compact having a high relative density results in the rare-earth magnet having a magnetic phase content of 80% by volume or more and even 90% by volume or more.

The use of the foregoing powder for a magnet according to the present invention, the powder including the antioxidation layer, inhibits a reduction in the magnetic phase content due to oxide inclusions. Also from this point of view, it is possible to obtain the rare-earth magnet having a high magnetic phase content. A rare-earth magnet obtained by polarizing the rare-earth-iron-nitrogen-based alloy material having a composition of $Sm_1Fe_{11}Ti_1N_1$ has a high flux density, a high coercive force, and excellent squareness of a demagnetization curve. Furthermore, in the rare-earth-iron-nitrogen-based alloy material having a composition of $Sm_1Fe_{11}Ti_1N_1$, nitriding is likely to be uniformly performed; hence, the alloy material is likely to have uniform magnet properties inside thereof. Also from this point of view, the resulting rare-earth magnet is excellent in magnet properties. In addition, the rare-earth-iron-nitrogen-based alloy material having a composition of $Sm_1Fe_{11}Ti_1N_1$ has a lower Sm content than $Sm_2Fe_{17}N_3$. It is thus possible to reduce the amount of Sm used.

Figure 2:
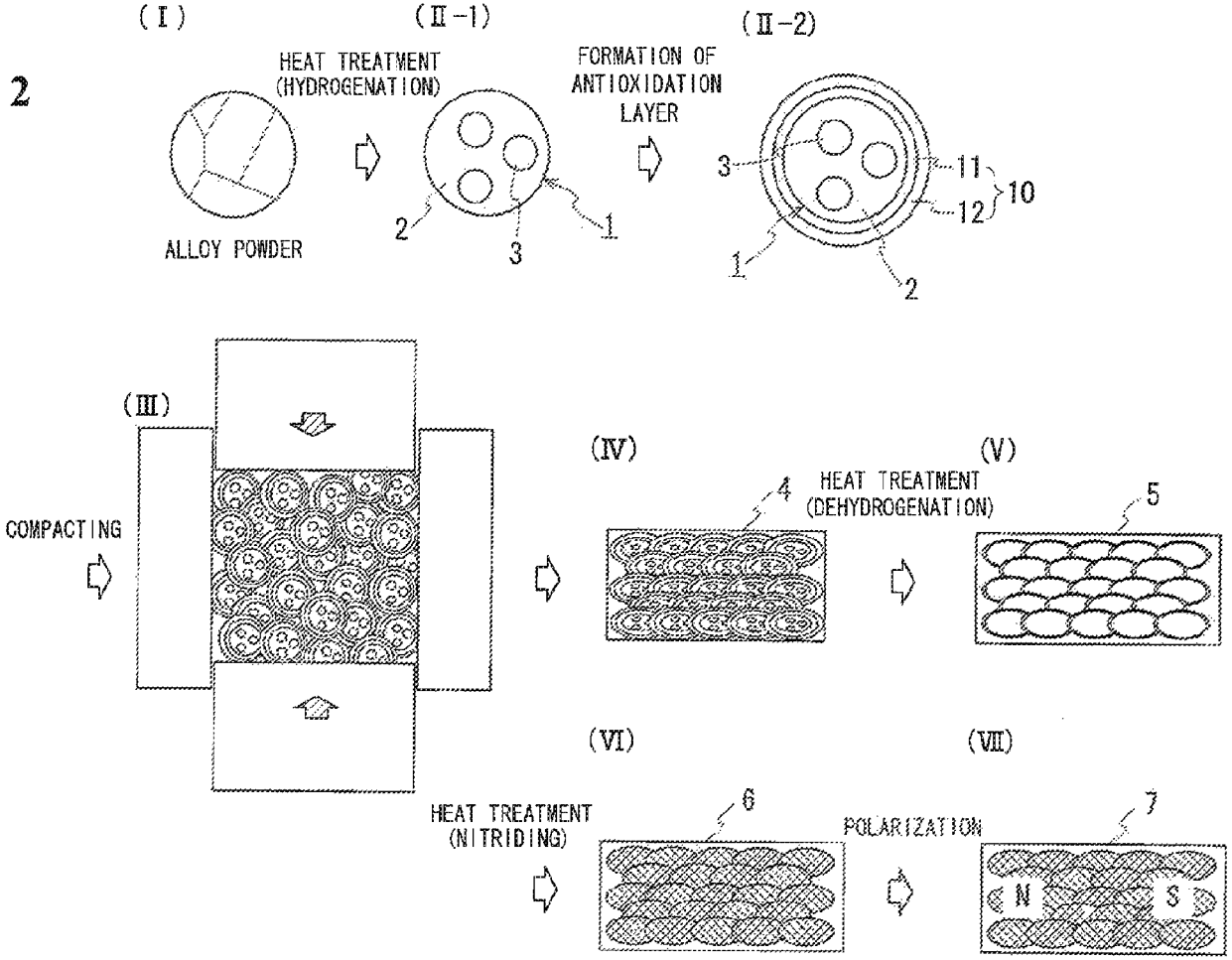
FIG. 2 is an explanatory process drawing illustrating an exemplary process for making a magnet from a powder for a magnet according to the present invention, the powder being produced in Test Example 3.

Embodiments of the present invention will be more specifically described below by test examples with reference to the attached drawings. In the drawings, the same elements are designated using the same reference numerals. In FIGS. 1 and 2, the hydride of the rare-earth element and the antioxidation layer are exaggerated for easy understanding.

Test Example 1

Various powders each containing a rare-earth element and an iron element were produced. The resulting powders were subjected to compacting to study the formability of the powders.

Each of the powders was produced by a procedure including a preparation step of preparing an alloy powder and then a hydrogenation step of performing heat treatment in a hydrogen atmosphere.

Ingots of rare-earth-iron-based alloys ($Sm_xFe_y$) having compositions illustrated in Table I were prepared. Each of the ingots was ground in an Ar atmosphere with a cemented carbide mortar to form an alloy powder having an average particle size of 100 μm (FIG. 1(I)). With respect to the average particle size, the particle size (50% particle size) corresponding to 50% of the cumulative weight was measured with a laser diffraction particle size distribution analyzer.

Each of the alloy powder was heat-treated in a hydrogen ($H_2$) atmosphere at 850° C. for 3 hours. The powder obtained from this hydrogenation heat treatment was bound with an epoxy resin to form a sample for texture observation. The sample was cut or polished at a desired position while the powder inside the sample was not oxidized. The composition of each of the particles constituting the powder present in the resulting cut section (or polished section) was studied with an energy dispersive X-ray (EDX) spectrometer. The cut section (or polished section) was observed with an optical microscope or a scanning electron microscope (SEM, at a magnification of ×100 to ×10000) to study the configuration of each of the particles constituting the powder. The results demonstrated that with respect to each of the resulting powders excluding some sample powders, as illustrated in FIG. 1(II), in each of magnetic particles 1 constituting the powder, a phase 2 of an iron-containing material (here, an Fe phase) served as a matrix phase, a plurality of granular phases 3 of the hydride of the rare-earth element (here, $SmH_2$) were dispersed in the matrix phase, and the phase 2 of the iron-containing material intervened between adjacent grains of the hydride of the rare-earth element.

Proportions (% by volume) of the hydride of the rare-earth element, i.e., $SmH_2$, and the iron-containing material, i.e., Fe, in each magnetic particle of each of the samples combined with the epoxy resin were determined Table I illustrates the results. With respect to the proportions, here, assuming that a silicone resin described below is present in a certain proportion on a volume basis (0.75% by volume), the volume ratios were determined by calculation. More specifically, the volume ratios were calculated on the basis of the compositions of the alloy powder used as a raw material and atomic weights of $SmH_2$ and Fe. Each of the resulting volume ratios was rounded to one decimal place. Table I illustrates the resulting values. Furthermore, the foregoing proportions may also be determined as follows: For example, proportions of areas of $SmH_2$ and Fe are determined with respect to the area of the cut section (or polished section) of each of the resulting compacts. The resulting proportions of the areas are converted into proportions on a volume basis. Alternatively, X-ray analysis is performed, and the resulting peak intensity ratios are used to determine the proportions.

The interval between adjacent grains of the hydride of the rare-earth element was measured using the surface analysis (mapping data), obtained with the EDX spectrometer, of the compositions of each powder. Here, the cut section (or polished section) was subjected to surface analysis to extract peak positions of $SmH_2$. All intervals between adjacent peak positions of $SmH_2$ were measured and averaged. Table I illustrates the results.

The powders were each coated with a silicone resin that was a precursor of a Si—O coating film serving as an insulating coating film to prepare powders with the insulating coating. Each of the prepared powders was subjected to compacting with an oil hydraulic press apparatus at a surface pressure of 10 ton/cm$^2$ (FIG. 1(III)). All samples except sample No. 1-8 were able to be sufficiently compacted at a surface pressured of 10 ton/cm$^2$ to form columnar powder compacts 4 (FIG. 1(IV)) having an outside diameter of 10 mm and a height of 10 mm. It is possible that for sample No. 1-8, an excessively small amount of the Fe phase caused difficulty in performing sufficient compression, thus failing to form a powder compact.

The actual densities (compaction density) and the relative densities (actual density with respect to the true density) of the resulting powder compacts were determined. Table I illustrates the results. The actual densities were measured with a commercially available density measuring apparatus. The true densities were determined by calculation on the basis of the volume ratios described in Table I, using a density of $SmH_2$ of 6.51 g/cm$^3$, a density of Fe of 7.874 g/cm$^3$, and a density of the silicone resin of 1.1 g/cm$^3$.

TABLE I

| Sample | Composition (at %) | | Volume ratio (%) | | | True density | Compaction density | Relative density | Interval |
|---|---|---|---|---|---|---|---|---|---|
| No. | Sm | Fe | $SmH_2$ | Fe | Silicone resin | g/cm$^3$ | g/cm$^3$ | % | μm |
| 1-1 | 0.0 | 100.0 | 0.0 | 99.3 | 0.75 | 7.82 | 7.62 | 97.4 | — |
| 1-2 | 2.5 | 97.5 | 7.8 | 91.5 | 0.75 | 7.72 | 7.50 | 97.1 | 6.3 |
| 1-3 | 5.0 | 95.0 | 14.8 | 84.6 | 0.75 | 7.63 | 7.26 | 95.1 | 2.9 |
| 1-4 | 7.5 | 92.5 | 21.1 | 78.3 | 0.75 | 7.55 | 7.05 | 93.4 | 2.6 |
| 1-5 | 10.0 | 90.0 | 26.8 | 72.6 | 0.75 | 7.47 | 6.89 | 92.2 | 2.4 |
| 1-6 | 12.5 | 87.5 | 32.0 | 67.4 | 0.75 | 7.41 | 6.71 | 90.6 | 1.6 |
| 1-7 | 15.0 | 85.0 | 36.8 | 62.7 | 0.75 | 7.34 | 6.31 | 85.9 | 1.3 |
| 1-8 | 17.5 | 82.5 | 41.2 | 58.4 | 0.75 | 7.29 | Incompactible | — | — |

As illustrated in Table I, the results demonstrate that in the case where the powders of the iron-containing material each contain the hydride of the rare-earth element in an amount of less than 40% by volume and the balance being substantially Fe and where the powders each have the texture in which the hydride of the rare-earth element is dispersed in the iron-containing material, powder compacts each having a complex shape and a high relative density of 85% or more and particularly 90% or more are made.

The resulting powder compacts were heated to 900° C. in a hydrogen atmosphere. The atmosphere was then switched to vacuum (VAC). The powder compacts were subjected to heat treatment in vacuum (an ultimate degree of vacuum of 1.0 Pa) at 900° C. for 10 minutes. An increase in temperature in the hydrogen atmosphere enables us to initiate a dehydrogenation reaction at a sufficiently high temperature, thereby inhibiting the occurrence of a nonuniform reaction. Compositions of the resulting columnar members after the heat treatment were studied with the EDX spectrometer. Table II illustrates the results. As illustrated in Table II, each of the columnar members except sample No. 1-1 was composed of a rare-earth-iron-based alloy material substantially containing iron and a rare-earth-iron-based alloy or was composed of a rare-earth-iron-based alloy material 5 (FIG. 1(V)) substantially containing a rare-earth-iron-based alloy, such as $Sm_2Fe_{17}$. This indicates that hydrogen was removed by the heat treatment.

The resulting rare-earth-iron-based alloy materials were subjected to heat treatment at 450° C. for 3 hours in a nitrogen ($N_2$) atmosphere. Compositions of the resulting columnar members after the heat treatment were studied with the EDX spectrometer. The results demonstrated that each of the columnar members was substantially composed of a rare-earth-iron-nitrogen-based alloy material 6 (FIG. 1(VI)) containing a rare-earth-iron-nitrogen-based alloy, such as $Sm_2Fe_{17}N_3$. This indicates that nitrides were formed by the heat treatment.

The resulting rare-earth-iron-nitrogen-based alloy materials were polarized at a pulsed magnetic field of 2.4 MA/m (=30 kOe). Then the magnet properties of the resulting samples (rare-earth magnets 7 composed of the rare-earth-iron-nitrogen-based alloy (FIG. 1(VII))) were studied with a BH tracer (DCBH Tracer, manufactured by Riken Denshi Co., Ltd). Table II illustrates the results. Similarly, sample No. 1-1 was also formed into a magnet. The magnet properties thereof are described in Table II. Here, with respect to the magnet properties, the saturation flux density Bs (T), the residual flux density Br (T), the intrinsic coercive force iHc (kA/m), and the maximum value of the product of the flux density B and the magnitude of the demagnetizing field H (BH)max (kJ/m$^3$) were determined.

TABLE II

| Sample No. | Appearance phase after dehydrogenation | Magnet properties after nitriding treatment Bs T | Br T | iHc kA/m | (BH)max kJ/m$^3$ |
|---|---|---|---|---|---|
| 1-1 | Fe | 2.03 | 0.1 | 0.3 | — |
| 1-2 | Fe, $Sm_2Fe_{17}$ | 1.83 | 0.28 | 120 | 16 |
| 1-3 | Fe, $Sm_2Fe_{17}$ | 1.63 | 0.76 | 650 | 110 |
| 1-4 | Fe, $Sm_2Fe_{17}$ | 1.55 | 0.95 | 740 | 152 |
| 1-5 | $Sm_2Fe_{17}$ | 1.46 | 0.92 | 820 | 168 |
| 1-6 | $Sm_2Fe_{17}$, $Sm_6Fe_{23}$ | 1.18 | 0.63 | 520 | 142 |
| 1-7 | $Sm_2Fe_{17}$, $Sm_6Fe_{23}$ | 1.09 | 0.58 | 390 | 63 |
| 1-8 | — | — | — | — | — |

Table II demonstrates that the rare-earth magnets have excellent magnet properties, the rare-earth magnets each being produced from the powder (powder for a magnet) composed of the iron-containing material which contains the hydride of the rare-earth element in an amount of less than 40% by volume and the balance being substantially Fe and in which the interval between adjacent grains of the hydride of the rare-earth element is 3 μm or less. In particular, the results demonstrate that the use of the powder having an Fe content of 90% by volume or less and the use of the powder compact having a relative density of 90% or more result in the rare-earth magnets having superior magnet properties.

Test Example 2

As with Test Example 1, rare-earth magnets were produced, and the magnet properties were studied.

In this test, ingots composed of a $Sm_2Fe_{17}$ alloy in which the atomic ratio (at %) of Sm to Fe, i.e., Sm:Fe, was approximately equal to 10:90 were prepared. Similarly to Test Example 1, alloy powders having an average particle size of 100 μm were produced and subjected to heat treatment in a hydrogen atmosphere at temperatures described in Table III for 1 hour. The $SmH_2$ content, the Fe content (% by volume), and the interval between adjacent $SmH_2$ phases of each of the powders obtained after the heat treatment were studied as in Test Example 1. Table III illustrates the results. Similarly to Test Example 1, configurations of particles constituting the powders obtained after the heat treatment were studied. The results demonstrated that in each of sample Nos. 2-3 to 2-6, the $SmH_2$ phase was granular and that in sample No. 2-2, the $SmH_2$ phase and the Fe phase were both layered. Note that the alloy powder of sample No. 2-1 was not subjected to the foregoing heat treatment.

Similarly to Test Example 1, the powders obtained after the heat treatment were subjected to compacting to provide powder compacts. However, sample No. 2-1 was not able to be compacted. Sample No. 2-2 was not sufficiently compacted. The reason for this is presumably that the foregoing alloy powders did not disproportionate sufficiently, thereby failing to allow the Fe phase to appear sufficiently.

The true densities, the actual densities, and the relative densities of the resulting powder compacts were determined as in Test Example 1. Table III illustrates the results.

TABLE III

| Sample No. | Heat-treatment temperature (hydrogenation treatment) ° C. | Volume ratio (%) $SmH_2$ | Fe | Silicone resin | True density g/cm³ | Compaction density g/cm³ | Relative density % | Interval μm |
|---|---|---|---|---|---|---|---|---|
| 2-1 | Untreated | — | — | — | — | Incompactible | — | — |
| 2-2 | 650 | 26.8 | 72.6 | 0.75 | 7.47 | Incompactible | — | 0. 3 |
| 2-3 | 750 | 26.8 | 72.6 | 0.75 | 7.47 | 6.58 | 88.0 | 0.9 |
| 2-4 | 850 | 26.8 | 72.6 | 0.75 | 7.47 | 6.89 | 92.2 | 2.4 |
| 2-5 | 950 | 26.8 | 72.6 | 0.75 | 7.47 | 6.95 | 93.0 | 2.6 |
| 2-6 | 1050 | 26.8 | 72.6 | 0.75 | 7.47 | 6.98 | 93.4 | 2.9 |

Table III demonstrates that a higher temperature of the hydrogenation heat treatment results in the powder compact having a higher relative density. The reason for this is presumably that an increase in temperature permitted the Fe phase to appear sufficiently, thereby improving the formability.

Similarly to Test Example 1, the resulting powder compacts were heated in a hydrogen atmosphere and subjected to heat treatment in vacuum (ultimate degree of vacuum: 1.0 Pa) at 900° C. for 10 minutes. Then the compositions thereof were studied as in Test Example 1. The results demonstrated that the powder compacts were composed of a rare-earth-iron-based alloy material substantially containing $Sm_2Fe_{17}$.

Furthermore, the resulting rare-earth-iron-based alloy materials were subjected to heat treatment at 450° C. for 3 hours in a nitrogen atmosphere to form rare-earth-iron-nitrogen-based alloy materials. The resulting rare-earth-iron-nitrogen-based alloy materials were polarized at a pulsed magnetic field of 2.4 MA/m (=30 kOe). Then the magnet properties of the resulting samples were studied as in Test Example 1. Table IV illustrates the results.

TABLE IV

| Sample No. | Appearance phase after dehydrogenation | Magnet properties after nitriding treatment Bs T | Br T | iHc kA/m | (BH) max kJ/m³ |
|---|---|---|---|---|---|
| 2-1 | $Sm_2Fe_{17}$ | — | — | — | — |
| 2-2 | $Sm_2Fe_{17}$ | — | — | — | — |
| 2-3 | $Sm_2Fe_{17}$ | 1.41 | 0.90 | 880 | 153 |
| 2-4 | $Sm_2Fe_{17}$ | 1.46 | 0.92 | 820 | 168 |
| 2-5 | $Sm_2Fe_{17}$ | 1.49 | 0.90 | 740 | 148 |
| 2-6 | $Sm_2Fe_{17}$ | 1.53 | 0.84 | 720 | 140 |

Table IV demonstrates that in the case where the powder (powder for a magnet) which is composed of the iron-containing material containing the hydride of the rare-earth element in an amount of less than 40% by volume and the balance being substantially Fe and in which the interval between adjacent phases of the hydride of the rare-earth element is 3 μm or less is used, and where the temperature of the hydrogenation heat treatment is adjusted to a relatively low level, the rare-earth magnet having a high coercive force and superior magnet properties is provided.

Test Example 3

A powder containing a rare-earth element and an iron element was produced. The resulting powder was subjected to compacting. The formability and the oxidation state of the powder were studied. In this test, the powder included magnetic particles each provided with an antioxidation layer on its surface.

The foregoing powder was produced by a procedure including a preparation step of preparing an alloy powder, a hydrogenation step of performing heat treatment in a hydrogen atmosphere, and a coating step of forming an antioxidation layer.

An alloy powder (FIG. 2(I)) which was composed of a rare-earth-iron-based alloy ($Sm_1Fe_{11}Ti_1$) and which had an average particle size of 100 μm was produced by a gas atomizing process (Ar atmosphere). The average particle size was measured as in Test Example 1. Here, the powder constituted by the particles each composed of a polycrystalline substance was produced by the gas atomizing process.

The alloy powder was subjected to heat treatment at 800° C. for 1 hour in a hydrogen atmosphere ($H_2$). Low-oxygen-permeability layers composed of a polyamide resin (here, nylon 6 with an oxygen permeability coefficient (30° C.) of $0.0011\times10^{-11}$ $m^3\cdot m/(s\cdot m^2\cdot Pa)$) were formed on the powder (hereinafter, referred to as a "base powder") obtained after the hydrogenation heat treatment. More specifically, the base powder was mixed with the polyamide resin dissolved in an alcohol solvent. The solvent was then evaporated. The resin was cured to form the low-oxygen-permeability layers composed of the polyamide resin. Here, the amount of the resin was adjusted in such a manner that the low-oxygen-permeability layers had an average thickness of 200 nm. Furthermore, low-moisture-permeability layers composed of polyethylene (with a moisture permeability coefficient (30° C.) of $50\times10^{-13}$ kg/(m·s·MPa)) were formed on the base powder including the low-oxygen-permeability layers. More specifically, the base powder including the low-oxygen-permeability layers was mixed with the polyethylene dissolved in a xylene solvent. The solvent was then evaporated. The polyethylene was cured to form the low-moisture-permeability layers composed of the polyethylene. Here, the amount of the polyethylene was adjusted in such a manner that the low-moisture-permeability layers had an average thickness of 250 nm. The thickness of the low-oxygen-permeability layers and the thickness of the low-moisture-permeability layers were defined as average thicknesses on the assumption that each of the layers was uniformly formed on the surface of a corresponding one of the magnetic particles constituting the base powder (volume of polyamide resin/sum of surface areas of magnetic particles) (volume of polyethylene/sum of surface areas of magnetic particles including low-oxygen-permeability layers). The surface areas of the magnetic particles may be measured by, for example, the BET method. The volume of the resin may be determined by, for example, measuring the resin weight by differential thermal analysis (DTA) or the like and performing calculation using the resin density. The implementation of the foregoing steps results in a powder for a magnet, the powder including the magnetic particles 1 each provided with an antioxidation layer 10 on the surface thereof, the antioxidation layer 10 including a low-oxygen-permeability layer 11 and a low-moisture-permeability layer 12 (the sum of the average thicknesses: 450 nm).

The resulting powder for a magnet was bound with an epoxy resin to form a sample for texture observation. The sample was cut or polished to form a cut section (or polished section) as in Test Example 1. The composition of each of the particles constituting the powder present in the resulting cut section (or polished section) was studied with an EDX spectrometer. The cut section (or polished section) was observed with a microscope as in Test Example 1 to study the configuration of each of the magnetic particles. The results demonstrated that as illustrated in FIGS. 2(II-1) and 2(II-2), in each of magnetic particles 1, the phase 2 of the iron-containing material (here, an Fe phase and an FeTi compound phase) served as a matrix phase, a plurality of granular phases 3 of the hydride of the rare-earth element (here, $SmH_2$) were dispersed in the matrix phase, and the phase 2 of the iron-containing material intervened between adjacent grains of the hydride of the rare-earth element. The results also demonstrated that as illustrated in FIG. 2(II-2), the substantially entire surface of each of the magnetic particles 1 was covered with the antioxidation layer 10 and kept away from the outside air. Furthermore, an oxide of the rare-earth element (here, $Sm_2O_3$) was not detected in the magnetic particles 1.

Similarly to Test Example 1, the interval between adjacent grains of the hydride of the rare-earth element was measured using the surface analysis (mapping data), obtained with the EDX spectrometer, of the composition of the resulting powder for a magnet, and was found to be 2.3 μm. Furthermore, as with Test Example 1, the $SmH_2$ content and the iron-containing material content (Fe and the FeTi compound) (% by volume) of each of the magnetic particles were determined That is, the $SmH_2$ content was 22% by volume, and the iron-containing material content was 78% by volume.

The circularity of the magnetic particles was determined using the sample combined with the epoxy resin and was found to be 1.09. The circularity is determined as follows: The sample is cut or polished at a desired position. The cut section (or polished section) is observed with, for example, an optical microscope or a SEM to obtain projected images of sections of the powder. The actual cross-sectional area Sr and the actual circumferential length of each magnetic particle are determined. The ratio of the actual cross-sectional area Sr to the area Sc of a perfect circle having a circumferential length equal to the actual circumferential length, i.e., Sr/Sc, is defined as the circularity of the particle. Here, 50 magnetic particles in the cut surface (or polished surface) are sampled. The average of the circularity values of the 50 magnetic particles is defined as the circularity of the magnetic particles.

The resulting powder for a magnet, the powder including the antioxidation layers, was subjected to compacting with an oil hydraulic press apparatus at a surface pressure of 10 ton/$cm^2$ (FIG. 2(III)). Here, the compacting was performed in an air atmosphere (air temperature: 25° C., humidity: 75% (high humidity)). As a result, it was possible to achieve sufficient compaction at a surface pressure of 10 ton/$cm^2$ to form a columnar powder compact 4 (FIG. 2(W)) with an outside diameter of 10 mm and a height of 10 mm.

The relative density of the resulting powder compact was determined as in Test Example 1 and found to be 93%. Furthermore, X-ray analysis of the powder compact revealed that no clear diffraction peak assigned to an oxide of the rare-earth element (here, $Sm_2O_3$) was detected.

As with Test Example 1, a powder compact having a complex shape and a high relative density of 90% or more is made from the powder produced in Test Example 3. In particular, in Test Example 3, the proportion of the iron-containing material is 78% by volume. The proportion of the iron-containing material, which is excellent in formability, is higher than that of sample No. 1-5 (iron-containing material: 72.6% by volume) having a Ti-free configuration and excellent magnetic properties described in Test Example 1; hence, the powder has superior formability. It was thus possible to accurately produce the high-density powder compact as described above. Furthermore, Test Example 3 demonstrates that the use of the powder for a magnet, the powder including the antioxidation layers, inhibits the formation of the oxide of the rare-earth element and results in a powder compact substantially free from the oxide.

The resulting powder compact was heated to 825° C. in a hydrogen atmosphere. The atmosphere was then switched to vacuum (VAC). The powder compact was subjected to heat treatment in vacuum (an ultimate degree of vacuum of 1.0 Pa) at 825° C. for 60 minutes. The composition of the columnar member obtained after the heat treatment was studied with the EDX spectrometer. The powder compact was composed of the rare-earth-iron-based alloy material 5 (FIG. 2(V)) containing $Sm_1Fe_{11}Ti_1$ serving as a main phase (92% by volume or more). This indicates that hydrogen was removed by the heat treatment.

Furthermore, X-ray analysis of the columnar member revealed that no clear diffraction peak assigned to an oxide of the rare-earth element (here, $Sm_2O_3$) or residues of the antioxidation layers was detected. The results demonstrate that the use of the powder for a magnet, the powder including the antioxidation layers, inhibits the formation of the oxide of the rare-earth element, such as $Sm_2O_3$, that causes a reduction in coercive force. Furthermore, here, each of the layers constituting the antioxidation layer is composed of the resins. Thus, both layers can sufficiently follow the deformation of the magnetic particles constituting the powder during the compacting, so that the powder has excellent formability. In addition, both layers have excellent adhesion and are less likely to be detached; hence, the powder has excellent resistance to oxidation.

The resulting rare-earth-iron-based alloy material was subjected to heat treatment at 425° C. for 180 minutes in a nitrogen ($N_2$) atmosphere. The composition of the resulting columnar member obtained after the heat treatment was studied with the EDX spectrometer. The results demonstrate that the columnar member is composed of the rare-earth-iron-nitrogen-based alloy material 6 (FIG. 2(VI)) substantially containing a rare-earth-iron-nitrogen-based alloy, such as $Sm_1Fe_{11}Ti_1N_1$. This indicates that the nitride was formed by the heat treatment.

The resulting rare-earth-iron-nitrogen-based alloy material was polarized as in Test Example 1. The magnet properties of the resulting rare-earth magnet 7 (FIG. 2(VII)) were studied as in Test Example 1. The results were as follows: The saturation flux density Bs (T) was 1.08 T. The residual flux density Br (T) was 0.76 T. The intrinsic coercive force iHc was 610 kA/m. The maximum value of the product of the flux density B and the magnitude of the demagnetizing field H (BH)max was 108 kJ/$m^3$. As described above, in particular, the rare-earth-iron-nitrogen-based alloy material composed of the rare-earth-iron-nitrogen-based alloy, such as $Sm_1Fe_{11}Ti_1N_1$, provides the rare-earth magnet having very excellent magnet properties even at a reduced amount of the rare-earth element used.

The foregoing embodiments may be appropriately changed without departing from the gist of the present invention and are not limited to the foregoing configurations. For example, the composition of the magnetic particles, the average particle size of the powder for a magnet, the thickness of the antioxidation layer, the relative density of the powder compact, various heat-treatment conditions (the heating temperature and the holding time), and so forth may be appropriately changed.

INDUSTRIAL APPLICABILITY

A powder for a magnet according to the present invention, a powder compact, a rare-earth-iron-based alloy material, and a rare-earth-iron-nitrogen-based alloy material which are made from the powder may be suitably used as raw materials for permanent magnets used in various motors, in particular, high-speed motors included in, for example, hybrid vehicles (HEVs) and hard disk drives (HDDs). A method for producing a powder for a magnet according to the present invention, a method for producing a rare-earth-iron-based alloy material according to the present invention, and a method for producing a rare-earth-iron-nitrogen-based alloy material according to the present invention may be suitably employed for the production of the powder for a magnet according to the present invention, the rare-earth-iron-based alloy material according to the present invention, and the rare-earth-iron-nitrogen-based alloy material according to the present invention. Furthermore, the rare-earth-iron-based alloy material according to the present invention may be used for magnetic members, such as a La—Fe-based magnetic refrigeration material, in addition to rare-earth magnets.

REFERENCE SIGNS LIST

1 magnetic particle,
2 phase of iron-containing material,
3 phase of hydride of rare-earth element,
4 powder compact,
5 rare-earth-iron-based alloy material,
6 rare-earth-iron-nitrogen-based alloy material,
7 rare-earth magnet
10 antioxidation layer,
11 low-oxygen-permeability layer,
12 low-moisture-permeability layer

The invention claimed is:

1. A rare-earth-iron-based alloy material for a rare-earth magnet, the rare-earth-iron-based alloy material comprising:
- a powder compact comprising:
  - magnetic particles each containing a hydride of a rare-earth element in an amount of less than 40% by volume and the balance being Fe;
  - a phase of the hydride of the rare-earth element is adjacent to a phase consisting of pure Fe, and
  - an interval between adjacent phases of the hydride of the rare-earth element with the phase of Fe provided therebetween is 3 μm or less, wherein:
  - the phase of the hydride of the rare-earth element is granular,
  - the granular hydride of the rare-earth element is dispersed in the phase of Fe,
  - the rare-earth element is Sm, and the hydride of the rare-earth element consisting of Sm and hydrogen,
  - an antioxidation layer is provided on the surface of each of the magnetic particles, the antioxidation layer including a low-oxygen-permeability layer composed of a material having an oxygen permeability coefficient at 30° C. of less than $1.0\times10^{-11}$ $m^3\cdot m/(s\cdot m^2\cdot Pa)$ and a low-moisture-permeability layer composed of a material having a moisture permeability coefficient at 30° C. of less than $1000\times10^{-13}$ kg/(m·s·MPa),
  - the low-oxygen-permeability layer is polyester or polyvinyl chloride,
  - the powder compact has a relative density of 85% or more, and
  - the rare-earth-iron-based alloy material is produced by heat-treating the powder compact in an inert atmosphere or in a reduced atmosphere.

2. The rare-earth-iron-based alloy material according to claim 1, wherein a rate of volume change between the heat-treated powder compact before the heat treatment and the rare-earth-iron-based alloy material after the heat treatment is 5% or less.

3. The rare-earth-iron-based alloy material according to claim 1, wherein the inert atmosphere comprises a nitrogen element-containing atmosphere.

4. The rare-earth-iron-nitrogen-based alloy material according to claim 3, wherein the rare-earth-iron-nitrogen-based alloy material comprises an Sm—Fe—Ti—N alloy.

5. The rare-earth-iron-nitrogen-based alloy material according to claim 3, wherein a rate of volume change between the rare-earth-iron-based alloy material before the heat treatment and the rare-earth-iron-nitrogen-based alloy material after the heat treatment is 5% or less.

* * * * *